US005526805A

United States Patent [19]

Lutz et al.

[11] Patent Number: 5,526,805

[45] Date of Patent: Jun. 18, 1996

[54] IN-LINE SILENCER FOR CLEAN ROOM BREATHING APPARATUS

[75] Inventors: Donald G. Lutz, San Ramon; Richard S. Dryden, San Jose; Gene J. Sullivan, Lafayette, all of Calif.

[73] Assignee: Dryden Engineering Company, Inc., Santa Clara, Calif.

[21] Appl. No.: 146,952

[22] Filed: Nov. 3, 1993

[51] Int. Cl.[6] ..... A62B 7/00

[52] U.S. Cl. ..... 128/204.18; 128/205.22; 128/205.12; 128/202.13

[58] Field of Search ..... 128/204.18, 205.12, 128/202.19, 200.24, 205.27, 205.29, 206.12, 912, 205.22, 205.25, 202.13; 181/22, 196, 198, 224, 227, 247, 256, 258, 288

[56] References Cited

U.S. PATENT DOCUMENTS

| | | | |
|---|---|---|---|
| Re. 31,275 | 6/1983 | Wirt | 181/224 |
| 3,960,142 | 6/1976 | Elliott et al. | 128/912 X |
| 4,127,130 | 11/1978 | Naysmith | 128/204.25 |
| 4,596,247 | 6/1986 | Whitwam et al. | 128/204.25 |
| 4,665,581 | 5/1987 | Oberdorfer | 15/326 |
| 4,988,436 | 1/1991 | Cole | 210/169 |
| 5,054,480 | 10/1991 | Bare et al. | 128/201.25 |
| 5,160,238 | 11/1992 | Kambara | 414/663 |
| 5,213,096 | 5/1993 | Kihlberg et al. | 128/205.12 |
| 5,297,990 | 3/1994 | Renz et al. | 454/187 |

*Primary Examiner*—Edgar S. Burr
*Assistant Examiner*—Eric P. Raciti
*Attorney, Agent, or Firm*—Limbach & Limbach

[57] ABSTRACT

Disclosed is an in-line silencer for a clean room breathing apparatus which reduces noise transmitted to a user from an attached air blower. The clean room breathing apparatus includes a headgear assembly worn by the user and an air blower that supplies air to or exhausts air from the headgear assembly through a connecting air hose. The in-line silencer is installed in the air duct between the air blower and the headgear assembly. The silencer has a shell housing with couplings at opposite ends for attaching the silencer in-line with the air blower and the connecting air hose. Within the shell housing of the silencer is a sound-absorbing material that absorbs sound energy from the air flowing through the silencer.

11 Claims, 3 Drawing Sheets

IN-LINE SILENCER FOR CLEAN ROOM BREATHING APPARATUS

BACKGROUND OF THE INVENTION

1. Field of the Invention

This invention relates generally to breathing apparatus for clean room environments, and relates more particularly to an in-line silencer for use with such breathing apparatus.

2. Description of the Relevant Art

Workers in clean rooms, surgical operating rooms, or other controlled environments are a source of contamination. A living, breathing person exhales hundreds of microscopic particles per minute. A smoker can exhale large quantities of particles for quite some time after smoking. Facial skin, cosmetics, and eye emissions are also sources of contaminating particles.

Masks made of fabric or foam are not very effective in containing such particulates. Consequently, clean room breathing apparatus have been developed which contain particles generated by the workers and prevent the particles from entering and thus contaminating the clean room environment.

A typical clean room breathing apparatus includes a headgear assembly with a hood or other accessories, generally having a clear face shield for viewing, and an air blower coupled to the headgear assembly through a connecting hose or duct. The air blower exhausts air contaminated with particles from the headgear assembly. The air blower in effect causes a slight vacuum within the headgear assembly so that particles generated by the worker are carried away by the air exhaust and do not enter the clean room. Replacement air enters the headgear assembly from the clean room. Located on the exhaust side of the air blower, a HEPA (High Efficiency Particulate Air) filter traps particles exhausted by the air blower so that they do not enter the clean room environment.

A variation of the above-described breathing apparatus has a second air blower that supplies air to the headgear assembly. The supply blower is similar to the exhaust blower, and has a separate hose or duct that carries air to the headgear assembly. Exhaust air, contaminated with particles generated by the user, is exhausted by the exhaust blower.

One problem that has developed with prior clean room breathing apparatus is that the noise generated by the air blower or blowers can impede communications among workers. To overcome this communication problem, some have gone to great expense to install electronic communication devices such as voice amplifiers. Another factor is that, since clean rooms have become quieter, the noise generated by the breathing apparatus has become more noticeable in comparison.

SUMMARY OF THE INVENTION

The present invention is an in-line silencer for a clean room breathing apparatus. The in-line silencer reduces noise transmitted to a user from an attached air blower. The clean room breathing apparatus in question includes a headgear assembly with a hood or other headgear enclosure, worn by the user, and an air blower that supplies air to or exhausts air from the headgear assembly through a connecting air hose. The in-line silencer is installed in the air duct between the air blower and the headgear assembly. The silencer has a shell housing with couplings at opposite ends for attaching the silencer in-line with the air blower and the connecting air hose. Within the shell housing of the silencer is a sound-absorbing material that absorbs sound energy from the air flowing through the silencer.

In the preferred embodiment, the shell housing of the silencer is cylindrical and has couplings or fittings at each end. The sound-absorbing material of the silencer is also preferably cylindrical, with an axial passage therethrough, which provides a low-resistance air flow path through the silencer. Various couplings or fittings can be utilized to enable the silencer to be positioned at a convenient position. The silencer of the present invention reduces the sound energy significantly, such as from 69 dBa without the silencer to 60 dBa with the silencer. The silencer thus results in a more comfortable and functional environment for the user.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter. It is, therefore, necessary to resort to the claims to determine the inventive subject matter.

DETAILED DESCRIPTION OF THE PREFERRED EMBODIMENT

FIGS. 1 through 7 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
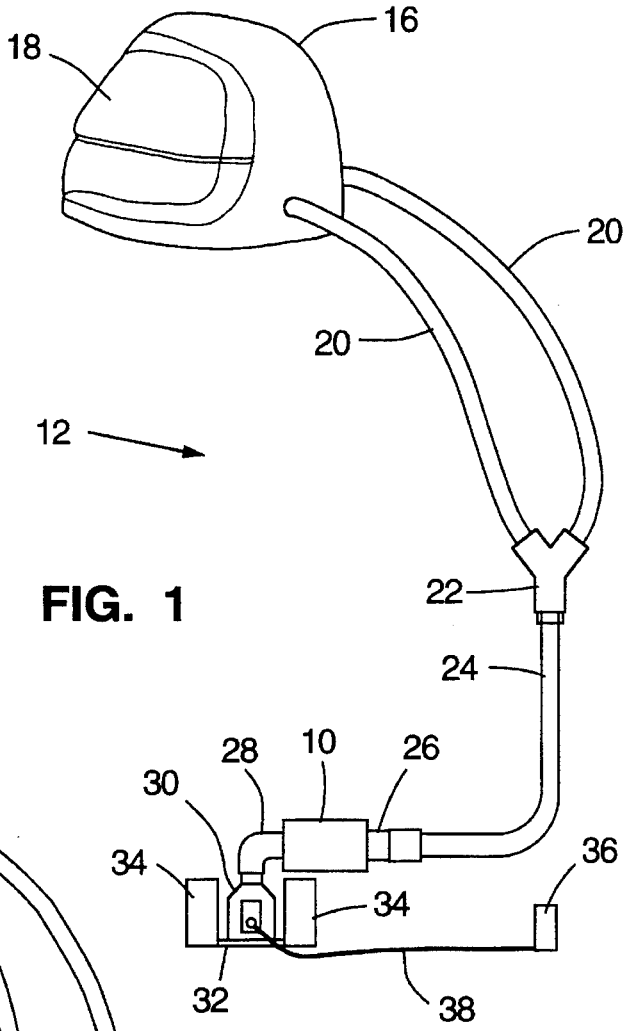
FIG. 1 is a perspective diagram of a clean room breathing apparatus having an in-line silencer of the present invention.
Figure 2:
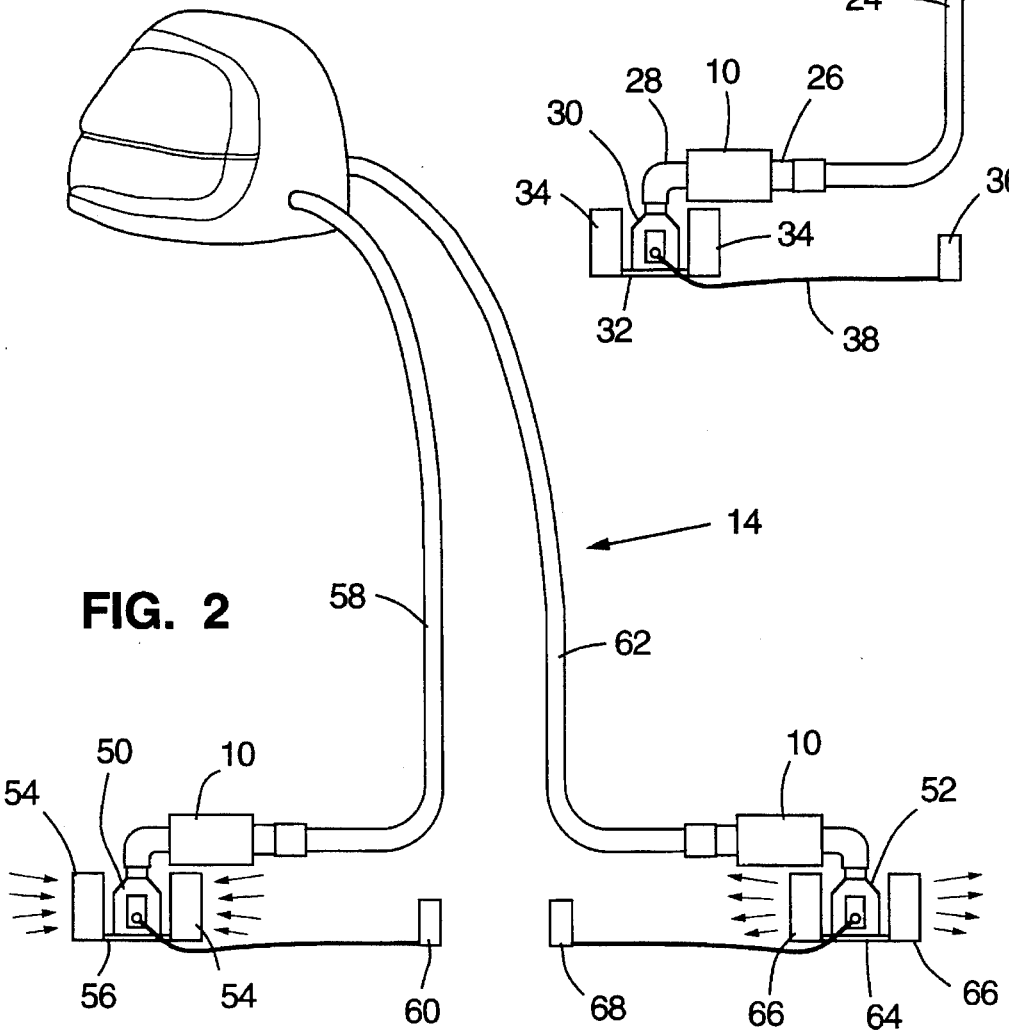
FIG. 2 is a perspective diagram of a clean room breathing apparatus having two in-line silencers of the present invention.

The present invention is an in-line silencer 10 for use with clean room breathing apparatus 12 and 14, as illustrated generally in FIGS. 1 and 2. Such breathing apparatus may be used in clean rooms for microelectronics, surgical operating rooms, pharmaceutical environments, and other environments where it is desired to control particulate contamination. Any references herein to clean rooms or clean room environments should be interpreted expansively, not narrowly, except as limited by the claims which follow.

The breathing apparatus 12 of FIG. 1 includes a headgear assembly 16 with a hood or other headgear enclosure worn by the user and generally containing a clear face shield 18.

Attached to the rear of the headgear assembly 16 are two connecting hoses 20 that are vented to the interior of the headgear assembly. The connecting hoses 20 are joined together by a Y-fitting 22. Another connecting hose 24 joins the Y-fitting 22 to a straight coupling 26 of the in-line silencer 10. A 90° elbow coupling 28 of the silencer 10 joins it to an air blower 30. An exhaust manifold 32 couples the exhaust side of the air blower 30 to two HEPA (High Efficiency Particulate Air) filters 34. A battery pack 36 provides electrical power to the air blower 30 through a cable 38. A belt, not shown, is provided to attach the silencer 10, air blower 30, and filters 34, and battery pack 36 to a user.

In operation, the user dons the headgear assembly 16 and attaches the silencer 10, air blower 30, filter 34, and battery pack 36 to the user's belt worn at their waist. The connecting hoses 20 and 24 trail down the back of the user. To use the breathing apparatus, the user connects the cord from the blower to the battery pack to turn on the air blower 30, which exhausts air from the headgear assembly 16 through the connecting hoses 20, Y-fitting 22, connecting hose 24, and silencer 10. The air blower 30 exhausts through the manifold 32 and filters 34, which traps the particles exhausted from the headgear assembly 16. By exhausting the air from the headgear assembly 16, the breathing apparatus prevents particles generated by the user from exiting the headgear assembly into the surrounding clean room. 35 The headgear assembly 16 has sufficient open area so that air can enter the headgear assembly from the clean room. The clean room breathing apparatus, including headgear assembly, air blower, filter, and connecting plumbing, is available from the assignee of the present application, Dryden Engineering Company, Inc. of Santa Clara, Calif., as its MAXIMUM™ shield system and particle control shields. Similar breathing apparatus are available from other sources as well.

The breathing apparatus 14 of FIG. 2 is similar to the apparatus 12 of FIG. 1, but has an air supply blower 50 in addition to an air exhaust blower 52. On the air supply side, the air supply blower 50 has two HEPA filters 54 joined to an intake side of the blower by a manifold 56. The exhaust side of the air supply blower 50 is coupled to an in-line silencer 10, which is in turn coupled to the headgear assembly 16 through a connecting hose 58 that is vented to the interior of the headgear assembly. The air supply blower 50 is powered by a battery pack 60 and functions to supply filtered air to the headgear assembly.

The air exhaust blower 52 of FIG. 2 works like the air blower 30 of FIG. 1. The air exhaust blower 52 exhausts air from the headgear assembly 16 through a connecting hose 62 and an in-line silencer 10. The air exhaust blower 52 exhausts to the surrounding room through a manifold 64 and filters 66. A battery pack 68 provides electrical power for the air exhaust blower 52.

In both breathing apparatus 12 and 14, the air blowers are acoustically isolated from the headgear assembly by the in-line silencer 10. The silencer 10 reduces the amount of noise transmitted to the user from the air blower(s) through the air duct structure and the air within the air duct.

Figure 3:
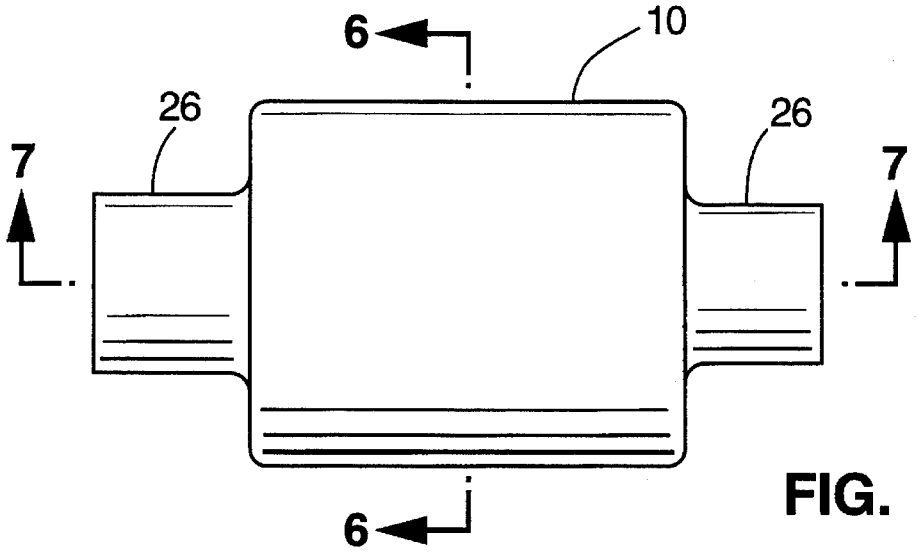
FIG. 3 is a view of an in-line silencer of the present invention having two straight fittings.
Figure 4:
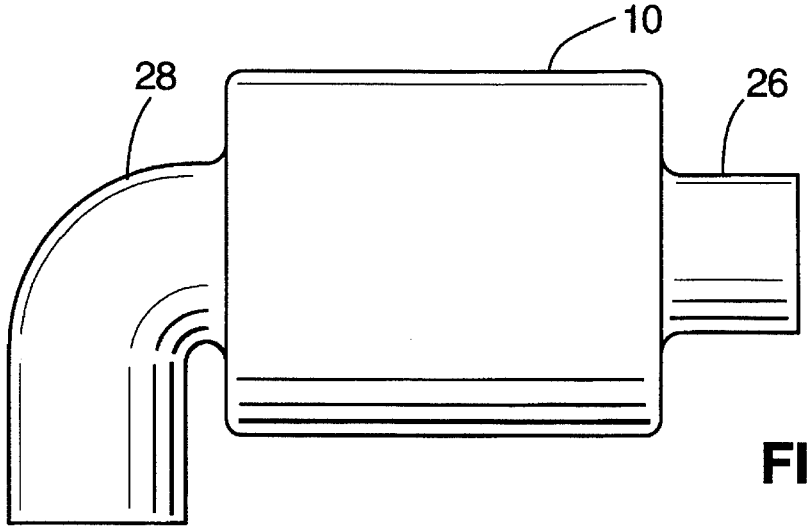
FIG. 4 is a view of an in-line silencer of the present invention having a straight fitting and a 90° elbow fitting.
Figure 5:
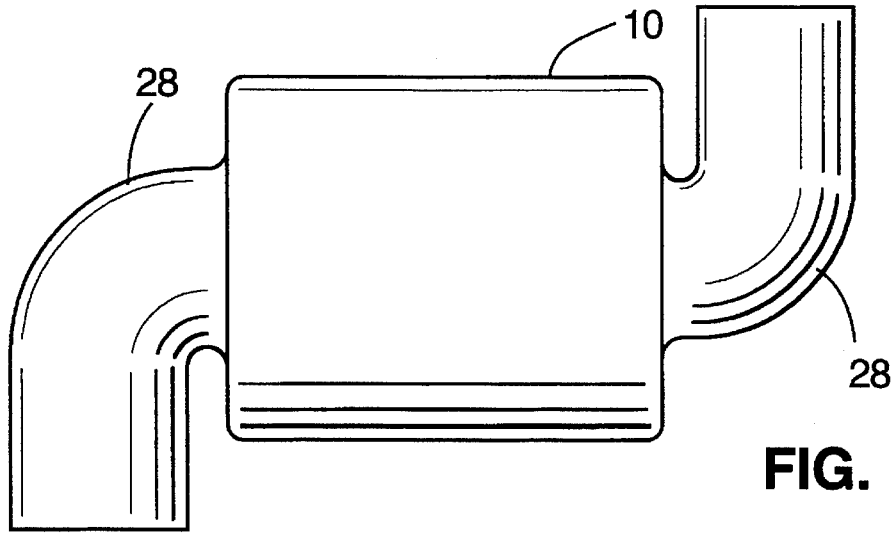
FIG. 5 is a view of an in-line silencer of the present invention having two 90° elbow fittings.

FIGS. 3, 4, and 5 illustrate three combinations of straight couplings 26 and 90° elbow couplings 28 which can be utilized with the in-line silencer 10. In each case, the couplings 26 and 28 are of conventional design and are sized to accommodate the air blower on one side and a connecting hose on the other side. The particular couplings 26 and 28 used for the silencer would depend on the desired relative orientations of the air blower, silencer, and connecting hose. The couplings 26 and 28 disclosed herein are examples, and other conventional pipe, tubing, hose, or duct couplings or fittings can be used.

Figure 6:
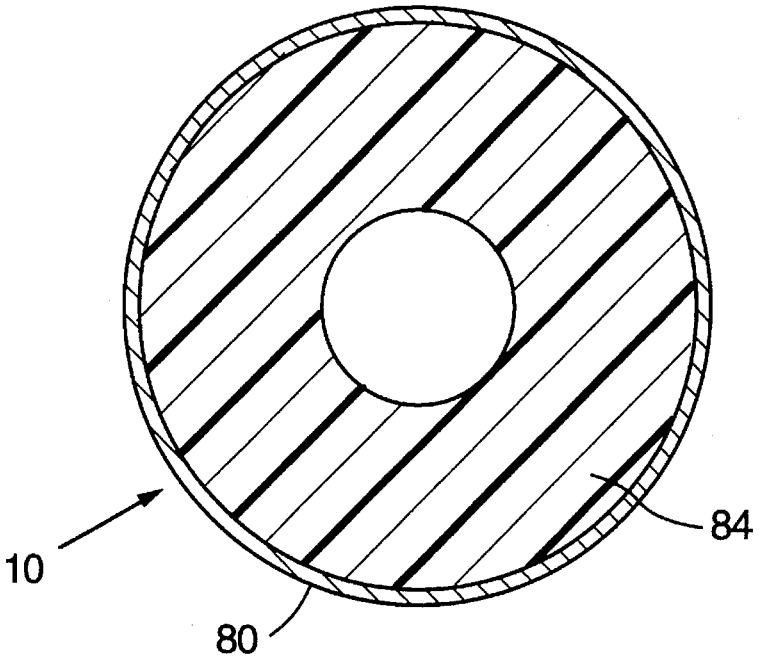
FIG. 6 is a lateral sectional view of the in-line silencer, as taken along section lines 6—6 of FIG. 3.
Figure 7:
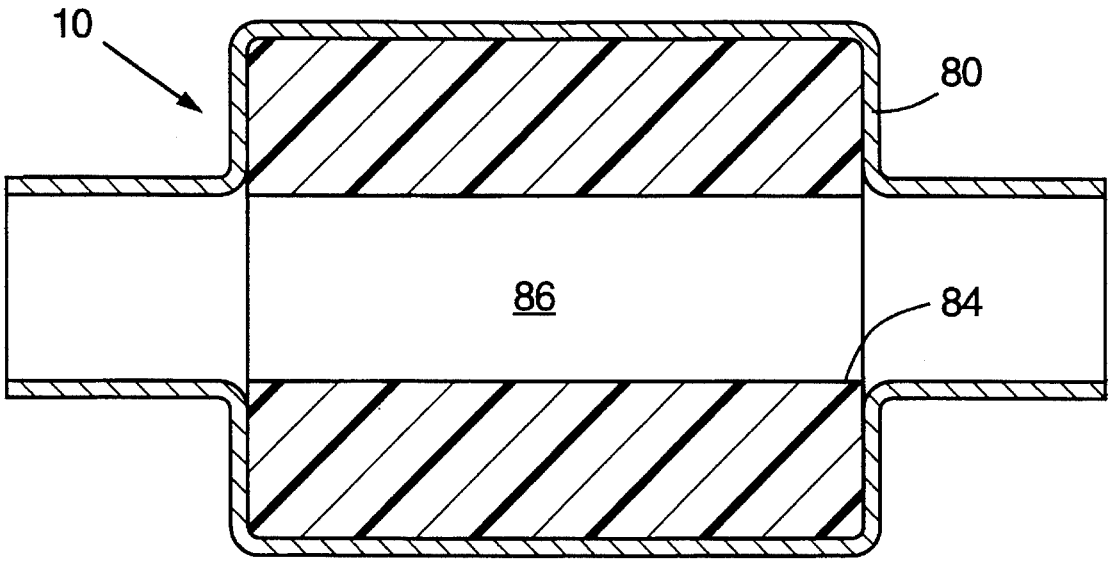
FIG. 7 is a longitudinal sectional view of the in-line silencer, as taken along section lines 7—7 of FIG. 3.

FIGS. 6 and 7 illustrate the structure of the silencer 10. The silencer has a shell housing 80 preferably molded in two joining pieces from ABS plastic. Inside the shell housing 80 is a cylindrical chamber that holds a sound-absorbing material 84, which is preferably a polyether urethane open cell acoustic grade foam. The sound-absorbing material 84 preferably has a density in the range of 2.0 to 6.0 pounds per cubic foot, and, more preferably, about 2.0 pounds per cubic foot. The sound-absorbing material 84 is an annular cylinder with an axial passage 86 along its longitudinal axis. The axial passage 86 allows the air to flow through the silencer without significant resistance. Acoustic energy is absorbed from the air as it flows past the sound-absorbing material 84.

The acoustic foam material 84 may be die cut from a sheet. If the thickness of the acoustic foam sheet is less than the length of the chamber, then multiple pieces can be die cut and stacked inside the silencer. The acoustic foam material may be an integral part of the silencer, or the silencer may be designed to be disassembled so that the foam material can be replaced.

From the above description, it will be apparent that the invention disclosed herein provides a novel and advantageous in-line silencer for reducing noise levels of clean room breathing apparatus. For example, the in-line silencer 10 could be positioned close to the headgear assembly 16 instead of close to the air blower 30, as illustrated. The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A clean room breathing apparatus comprising:

a headgear assembly including ducting means for supplying air to or exhausting air from the vicinity of the face of a user wearing the headgear assembly;

a connecting hose having one end thereof coupled to the headgear assembly;

an air blower carried by the user and coupled to another end of the connecting hose and capable of supplying air to or exhausting air from the headgear assembly; and an in-line silencer means separate from the headgear assembly and coupled in series with the connecting hose between the air blower and the headgear assembly for reducing noise transmitted from the air blower to the user, wherein the silencer means includes an impervious shell housing having couplings at opposite ends of the shell housing, and a sound-absorbing material contained within the shell housing and defining an air flow path through the shell housing, wherein air enters the in-line silencer through one coupling and exits through the other coupling, and wherein the air flow path extends through the in-line silencer between the two couplings thereof.

2. A clean room breathing apparatus as recited in claim 1 wherein the couplings of the shell housing include two straight fittings, one on each end of the shell housing.

3. A clean room breathing apparatus as recited in claim 1 wherein the couplings of the shell housing include a straight fitting on one end of the shell housing and a 90° elbow fitting on the other end of the shell housing.

4. A clean room breathing apparatus as recited in claim 1 wherein the couplings of the shell housing include two 90° elbow fittings, one on each end of the shell housing.

5. A clean room breathing apparatus as recited in claim 1 further comprising a filter coupled to the air blower on a side opposite the silencer means.

6. A clean room breathing apparatus as recited in claim 1 wherein the shell housing is cylindrical in shape, and wherein the air flow path extends axially along an axis of rotation of the cylindrical shell housing.

7. A clean room breathing apparatus as recited in claim 1 wherein the sound-absorbing material within has a cylindrical core defining the air flow path.

8. A clean room breathing apparatus as recited in claim 1 wherein the cross-sectional area of the air flow path through the sound-absorbing material is substantially equal to the cross-sectional area of an air flow path through the connecting hose.

9. A clean room breathing apparatus as recited in claim 9 wherein the sound-absorbing material is a polyether urethane open cell acoustic grade foam.

10. A clean room breathing apparatus as recited in claim 9 wherein the polyether urethane open cell acoustic grade foam has a density in the range of 2.0 to 6.0 pounds per cubic foot.

11. A clean room breathing apparatus comprising:

a headgear assembly including ducting means for supplying air to or exhausting air from the vicinity of the face of a user;

two connecting hoses each having one end thereof coupled to the headgear assembly;

an air supply blower coupled to an end of one connecting hose and capable of supplying air to the headgear assembly;

an air exhaust blower coupled to an end of another connecting hose and capable of exhausted air from the headgear assembly;

a first silencer means coupled between the air supply blower and the headgear assembly for reducing noise transmitted from the air supply blower to the user, wherein the first silencer means includes a shell housing having couplings at opposite ends of the shell housing, and a sound-absorbing material contained within the shell housing and defining an air flow path through the shell housing; and a second silencer means coupled between the air exhaust blower and the headgear assembly for reducing noise transmitted from the air exhaust blower to the user, wherein the second silencer means includes a shell housing having couplings at opposite ends of the shell housing, and a sound-absorbing material contained within the shell housing and defining an air flow path through the shell housing.

* * * * *